US005603501A

United States Patent [19]

Hayes

[11] Patent Number: 5,603,501

[45] Date of Patent: Feb. 18, 1997

[54] MATHEMATICAL BOARD GAME

[76] Inventor: Mark G. Hayes, 4142 N. Castleridge Dr., Grand Rapids, Mich. 49508

[21] Appl. No.: 550,295

[22] Filed: Oct. 30, 1995

[51] Int. Cl.[6] ..... A63F 3/00

[52] U.S. Cl. ..... 273/272; 273/299; 273/240

[58] Field of Search ..... 273/287, 293, 273/302, 304, 305, 236, 272, 299; 434/209, 192, 188, 191

[56] References Cited

U.S. PATENT DOCUMENTS

| | | | |
|---|---|---|---|
| 1,115,441 | 10/1914 | Lake | 273/299 |
| 2,198,670 | 4/1940 | Johnson | 273/299 |
| 2,811,360 | 10/1957 | Cohen | 273/272 |
| 5,102,339 | 4/1992 | Parriera | 273/272 |
| 5,314,190 | 5/1994 | Lyons | 273/272 |
| 5,366,226 | 11/1994 | McGowan | 273/272 |

FOREIGN PATENT DOCUMENTS 5811 4/1915 United Kingdom .

*Primary Examiner*—Benjamin H. Layno
*Assistant Examiner*—Stephen L. Blau
*Attorney, Agent, or Firm*—Chamberlain Hrdlicka, White, Williams & Martin; Cynthia G. Seal

[57] ABSTRACT

The present invention provides for a game system having a generally rectangularly shaped board and a plurality of cards. The board is imprinted with indicia indicating addition, subtraction, multiplication, and division. The board is also imprinted with indicia indicating a first playing area, a second playing area, a third playing area, a fourth playing area, fifth playing area, a sixth playing area, a seventh playing area, and an eighth playing area. The cards are inscribed with an integer n, where n is an integer from 0 to 12. The cards are also inscribed with a mathematical symbol of +, −, ×, and ÷. In another embodiment of the present invention, there is provided a method for playing a mathematical board game. The method involves providing a board as described above with at least one erasable means for recording a score, and cards as described above. The plurality of cards are shuffled to form a deck. A first player and a second are provided each with a predetermined number cards out of the deck. The first player places two cards with the same mathematical symbol on the board and calculates a first score according to the integers on the two cards and the mathematical function required by the symbol indicated on the two cards. The first player records the first score on the at least one erasable means for recording a score, and draws two replacement cards from the deck. The object of the game is to reach a predetermined score. If a player's score is over the predetermined limit, the player must figure a way to get a negative score to reduce his score to the correct number.

14 Claims, 3 Drawing Sheets

MATHEMATICAL BOARD GAME

BACKGROUND OF THE INVENTION

This invention relates to a game system. In one aspect, the invention relates to a mathematical board game. In another aspect, this invention relates to a method for playing a mathematical board game.

Challenging board games requiring mathematical skill have been popular for many years. There are several types of board games on the market today designed to challenge the player's mathematical and strategic skills. Most of these games do not accommodate younger children. A challenging mathematical board game that younger as well as older children can play would be highly desirable.

OBJECTS OF THE INVENTION

It is an object of the present invention to provide a mathematical game that children of any age can play.

It is a further object of the present invention to provide a method for playing a mathematical game that children of any age can play.

SUMMARY OF THE INVENTION

The present invention provides for a game system having a generally rectangularly shaped board and a plurality of cards. The board has a center, a first corner, a second corner, a third corner and a fourth corner. The board is imprinted with indicia indicating addition, subtraction, multiplication, and division. The board is also imprinted with indicia indicating a first playing area, a second playing area, a third playing area, a fourth playing area, fifth playing area, a sixth playing area, a seventh playing area, and an eighth playing area. The cards are inscribed with an integer n, where n is an integer from 0 to 12. The cards are also inscribed with a mathematical symbol of +, −, ×, and ÷.

The game is played on a board and cards as described above preferably with at least one erasable means for recording a score. The plurality of cards are shuffled to form a deck. A first player and a second player are provided each with a predetermined number cards out of the deck. The first player places two cards with the same mathematical symbol on the board and calculates a first score according to the integers on the two cards and the mathematical function required by the symbol indicated on the two cards. The first player records the first score on the at least one erasable means for recording a score, and draws two replacement cards from the deck. The second player then similarly plays and draws two cards, and the game progresses.

The object of the game is to exactly reach a predetermined score. If a player's score is over the predetermined limit, the player must figure a way to get a negative score to reduce his score to the correct number.

DETAILED DESCRIPTION OF THE PREFERRED EMBODIMENTS

Figure 1:
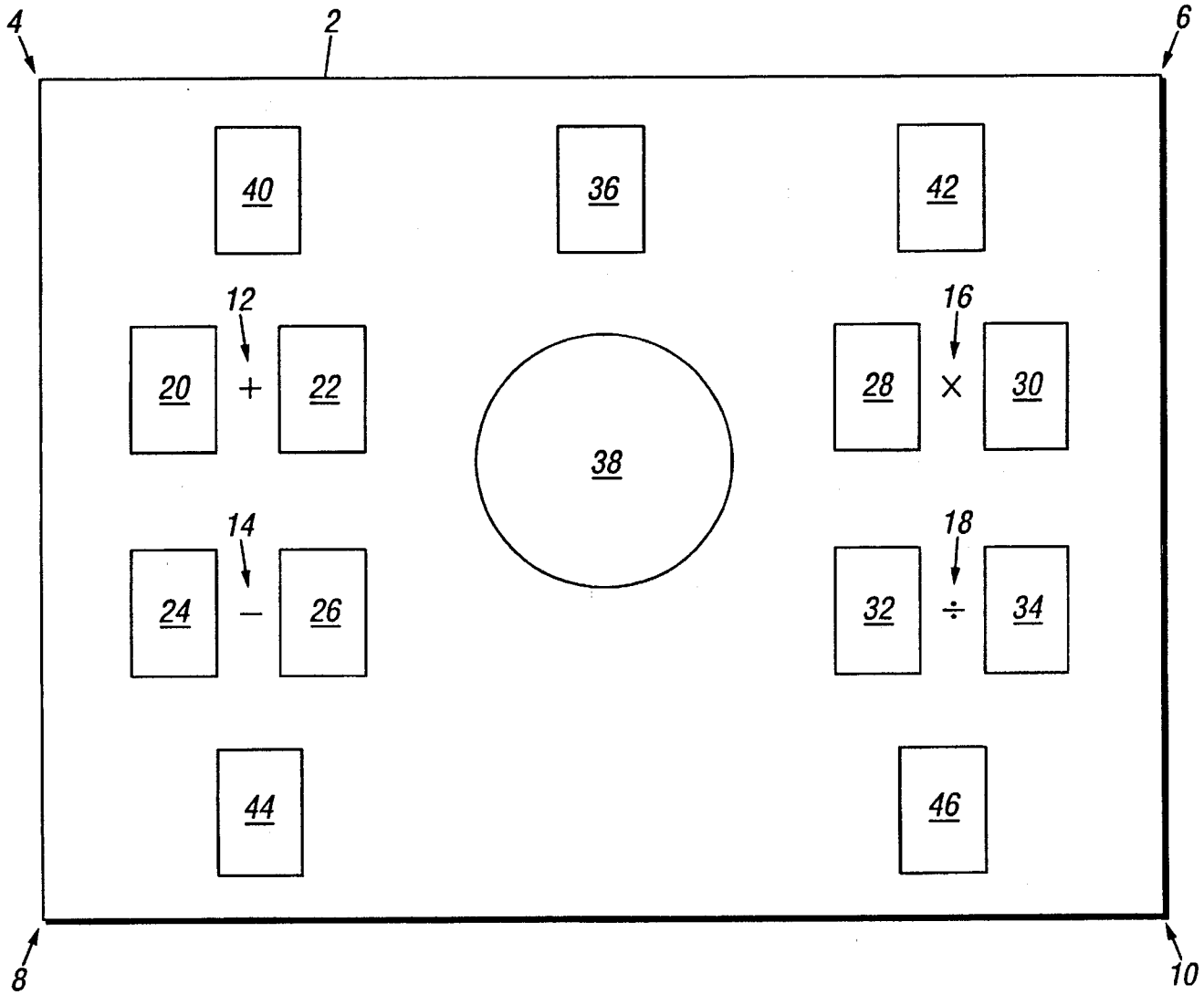
FIG. 1 is a plan view of the invention showing the board.
Figure 2A:
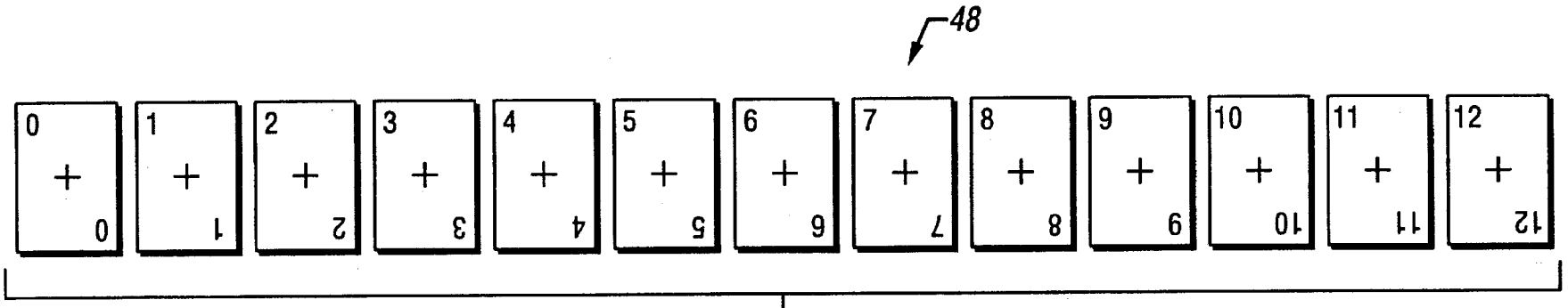
FIGS. 2*a–d* are a plan view of the addition, subtraction, multiplication, and division cards.
Figure 2B:
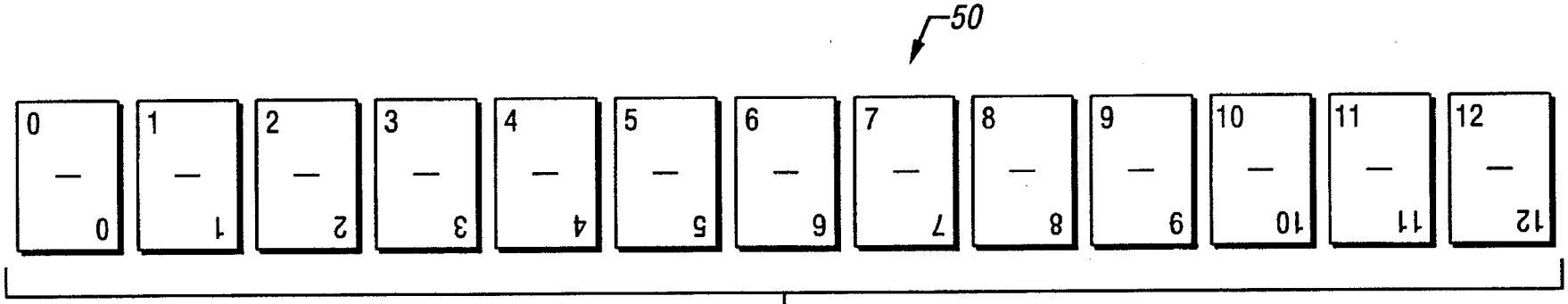
Figure 2C:
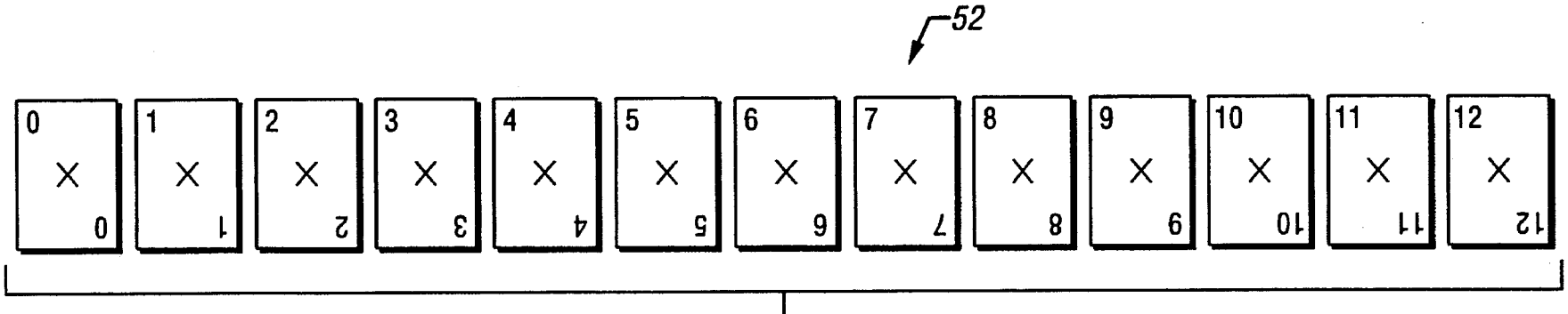
Figure 2D:
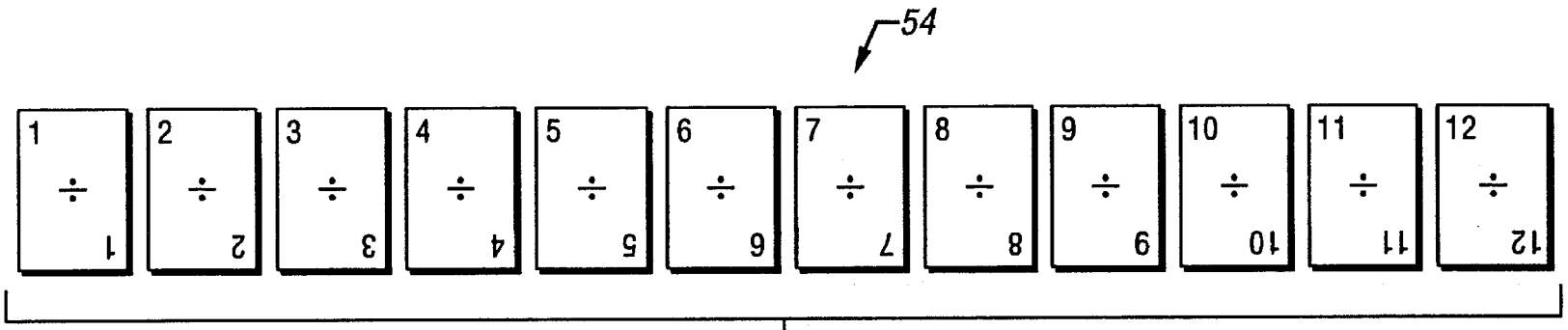

The present invention provides for a game system having a generally rectangularly shaped board 2 and a plurality of cards 36. The board 2 has a center, a first corner 4, a second corner 6, a third corner 8 and a fourth corner 10. The board 2 is imprinted with indicia indicating addition 12, subtraction 14, multiplication 16, and division 18. The board 2 is also imprinted with indicia indicating a first playing area 20, a second playing area 22, a third playing area 24, a fourth playing area 26, fifth playing area 28, a sixth playing area 30, a seventh playing area 32, and an eighth playing area 34. Preferably, an erasable means for recording a score is rotatably mounted in the center of the board 2. The erasable means can be a resin layer with a liftable, opaque overlay fixedly attached thereto and superposed with the resin layer. In a preferred embodiment, there is provided, a first means for recording a score 40, a second means for recording a score 42, a third means for recording a score 44 and a fourth means for recording a score 46.

The cards 36 are inscribed with an integer n, preferably where n is an integer from 0 to 12 and a mathematical symbol of +, −, ×, and ÷. In a preferred embodiment, the plurality of cards 36 comprises a first 48, second 50, third 52, and fourth 54 plurality of cards. The first plurality of cards 48 are inscribed with one integer n, and one + symbol, wherein n is an integer from 0 to 12. The second plurality of cards 50 are inscribed with one integer n, and one − symbol, wherein n is an integer from 0 to 12. The third plurality of cards 52 are inscribed with one integer n, and one × symbol, wherein n is an integer from 0 to 12. The fourth plurality of cards 54 are inscribed with one integer n, and one ÷ symbol, wherein n is an integer from 1 to 12.

In a preferred embodiment, the first playing area 20 and the second playing area 22 are positioned in a side by side relationship with the + symbol positioned therebetween. The third playing area 24 and the fourth playing area 26 are positioned in a side by side relationship with the − symbol positioned therebetween. The fifth playing area 28 and the sixth playing area 30 are positioned in a side by side relationship with the ÷ symbol positioned therebetween. The seventh playing area 32 and the eighth playing area 34 are positioned in a side by side relationship with the ÷ symbol positioned therebetween.

In another embodiment of the present invention, there is provided a method for playing a mathematical board game. The method comprises providing a board 2 and cards 36 as described above. The board 2 preferably has an erasable means for recording a score 38 rotatably mounted in the center of the board 2. The plurality of cards 36 are shuffled to form a deck. A first player and a second player are provided each with a predetermined number cards out of the deck, preferably an odd number of cards. The first player places two cards with the same mathematical symbol on the board 2 and calculates a first score according to the integers on the two cards and the mathematical function required by the symbol indicated on the two cards. The first player records the first score on the at least one erasable means for recording a score, and draws two replacement cards from the deck. Then preferably, the second player places two cards with the same mathematical symbol on the board 2 and calculates a second score according to the integers on the two cards and the mathematical function required by the symbol indicated on the two cards. The second player records the second score on the at least one erasable means for recording a score, and draws two replacement cards from the deck.

Preferably, the first player then places two cards with the same mathematical symbol on the board 2 and calculates a third score according to the integers on the cards and the mathematical function required by the symbol indicated on the two cards. The first player records the first score and the third score on the erasable means for recording a score 38 rotatably mounted in the center of the board 2 and adds the first score to the third score to get a fourth score. The first player then records the fourth score on the erasable means for recording a score. Alternatively, the first player may discard two cards and draw two replacement cards from the deck.

Preferably, the second player then places two cards with the same mathematical symbol on the board 2 and calculates a fifth score according to the integers on the cards and the mathematical function required by the symbol indicated on the two cards. The second player records the second score and the fourth score on the erasable means for recording a score 38 rotatably mounted to the center of the board 2 and adds the second score to the fifth score to get a sixth score. The second player then records the sixth score on the erasable means for recording a score. The first player and second player repeat the steps above until one of the player's reaches a predetermined score, for example, a score of 100.

EXAMPLE

The mathematical board game is played by providing a board, a deck of cards, a means for recording a score in the center of the board and several means for recording scores for each of the players. The board has eight playing areas that can be card slots for holding the cards after a player has taken their turn. The board is inscribed with a +, –, ×and ÷ symbol each positioned between two of the eight card slots or playing areas. There can also be slots for holding the deck that the players draw from and the cards that a player may discard. The deck of cards has at least one set of each of the following cards: a) a group of cards inscribed with a + symbol and an integer n, wherein n is an integer from 0–12; b) a group of cards inscribed with a – symbol and an integer n, wherein n is an integer from 0–12; c) a group of cards inscribed with a × symbol and an integer n, wherein n is an integer from 0–12; d) a group of cards inscribed with a ÷ symbol and an integer n, wherein n is an integer from 1–12. The means for recording a score for each of the players are preferably erasable and can be made of a material commercially known as "magic slate" made of a resin board with an opaque plastic sheet overlay. The "magic slate" allows each player to erase their old score and keep track of their current total score after each turn. The means for recording a score in the center of the board is preferably a rotatably mounted disc and can also be made of the "magic slate" material. This enables each player to write their previous score on the disc and the new score to be added to calculate their total score at the end of each player's turn. The player then records his or her score on their individual score pad.

The game can be played with one player or preferably six players, for simplicity we will use two players. The object of the game is to reach an exact score agreed upon before the game begins. To play the game each player draws one card from the deck and the player with the highest score goes first. Each player is dealt five cards from the deck. The first player takes two cards from their hand having the same mathematical symbol and places them on the board in the slots adjacent the same symbol. The first player calculates their score according to the numbers and the mathematical symbol on the cards and records that score on their individual score pad. Then the first player draws two replacement cards from the deck. The second player then takes two cards from their hand having the same mathematical symbol and places them on the board in the slots adjacent the same symbol. The second player calculates their score according to the numbers and the mathematical symbol on the cards and records that score on their individual score pad. Then the second player draws two replacement cards from the deck. The first player then takes two cards from their hand having the same mathematical symbol and places them on the board in the slots adjacent the same symbol. The first player then writes the previous score from their score pad on the score plate in the center of the board and the new score from their current turn and adds the two together to get a total score. The total score is recorded on the first player's individual score pad and the second player takes their turn. The player's alternate turns until one player reaches 100. Strategically, if a player does not want to use the cards in his hand for his turn, he may discard two cards and draw two replacement cards without changing his score. If a player goes over 100, then they would need to subtract two cards to get a negative score to reduce their score to 100.

What is claimed is:

1. A game system comprising a generally rectangularly shaped board having, a center, a first corner, a second corner, a third corner and a fourth corner, said board having indicia imprinted thereon to indicate addition, subtraction, multiplication, and division.

said board having indicia imprinted thereon for indicating a first playing area, a second playing area, a third playing area, a fourth playing area, fifth playing area, a sixth playing area, a seventh playing area, and an eighth playing area, a plurality of cards, wherein each card being inscribed with only one integer n, wherein n is an integer from 0 to 12 and only one mathematical symbol selected from the group consisting of +, –, ×, and ÷.

2. A system as in claim 1, further comprising an erasable means for recording a score comprising a disc rotatably mounted in the center of the board.

3. A system as in claim 1, further comprising a first means for recording a score, a second means for recording a score, a third means for recording a score and a fourth means for recording a score.

4. A system as in claim 1, wherein the first playing area and the second playing area are positioned in a side by side relationship with the + symbol positioned therebetween, the third playing area and the fourth playing area are positioned in a side by side relationship with the – symbol positioned therebetween, the fifth playing area and the sixth playing area are positioned in a side by side relationship with the × symbol positioned therebetween, and the seventh playing area and the eighth playing area are positioned in a side by side relationship with the ÷ symbol positioned therebetween.

5. A system as in claim 1, wherein the plurality of cards further comprises a first plurality of cards being inscribed with one integer n, and one + symbol, wherein n is an integer from 0 to 12, a second plurality of cards being inscribed with one integer n, and one – symbol, wherein n is an integer from 0 to 12, a third plurality of cards being inscribed with one integer n, and one × symbol, wherein n is an integer form 0 to 12, and a fourth plurality of cards being inscribed with one integer n, and one ÷ symbol, wherein n is an integer from 1 to 12.

6. A system as in claim 2, wherein the erasable means for recording a score comprises a resin layer with a liftable, opaque overlay fixedly attached thereto and superposed with the resin layer.

7. A method for playing a mathematical board game said method comprising a. providing a generally rectangularly shaped board having indicia indicating a first playing area, a second playing area, a third playing area, a fourth playing area, a fifth playing area, a sixth playing area, a seventh playing area, and an eighth playing area, and indicia imprinted thereon to indicate addition, subtraction, multiplication, and division, b. providing at least one erasable means for recording a score, c. providing a plurality of cards, wherein each card being inscribed with only one integer n, and only one mathematical symbol selected from the group consisting of +, −, ×, and ÷, wherein n is an integer from 0 to 12;

d. shuffling the plurality of cards and forming a deck;

e. providing a first player and a second player each with a predetermined number cards out of the deck, f. said first player placing two cards with the same mathematical symbol on the board, g. said first player calculating a first score according to the integers on the two cards and the mathematical function required by the symbol indicated on the two cards, h. said first player recording the first score on the at least one erasable means for recording a score, and i. said first player drawing two replacement cards from the deck.

8. A method as in claim 7, wherein the board further comprises an erasable means for recording a score rotatably mounted in the center of the board.

9. A method as in claim 7, wherein the first playing area and the second playing area are positioned in a side by side relationship with the + symbol positioned therebetween, the third playing area and the fourth playing area are positioned in a side by side relationship with the − symbol positioned therebetween, the fifth playing area and the sixth playing area are positioned in a side by side relationship with the × symbol positioned therebetween, and the seventh playing area and the eighth playing area are positioned in a side by side relationship with the ÷ symbol positioned therebetween.

10. A method as in claim 7, further comprising a. said second player placing two cards with the same mathematical symbol on the board, b. said second player calculating a second score according to the integers on the two cards and the mathematical function required by the symbol indicated on the two cards, c. said second player recording the second score on the at least one erasable means for recording a score, and d. said second player drawing two replacement cards from the deck.

11. A method as in claim 10, further comprising a. said first player placing two cards with the same mathematical symbol on the board and calculating a third score according to the integers on the cards and the mathematical function required by the symbol indicated on the two cards, b. said first player recording said first score and said third score on the erasable means for recording a score and adding said first score to said third score to get a fourth score, c. said first player recording the fourth score on the erasable means for recording a score, d. said first player repeating steps a–c until said first player reaches a predetermined score.

12. A method as in claim 11, further comprising a. said second player placing two cards with the same mathematical symbol on the board and calculating a fifth score according to the integers on the cards and the mathematical function required by the symbol indicated on the two cards, b. said second player recording said second score and said fifth score on the erasable means for recording a score and adding said second score to said fifth score to get a sixth score, c. said second player recording the sixth score on the erasable means for recording a score, d. said second player repeating steps a–c until said second player reaches a predetermined score.

13. A method as in claim 12, further comprising said first player, discarding two cards and drawing two replacement cards from the deck.

14. A method as in claim 7, wherein the plurality of cards comprises a first plurality of cards being inscribed with one integer n, and one + symbol, wherein n is an integer from 0 to 12, a second plurality of cards being inscribed with one integer n, and one − symbol, wherein n is an integer from 0 to 12, a third plurality of cards being inscribed with one integer n, and one × symbol, wherein n is an integer from 0 to 12 and a fourth plurality of cards being inscribed with one integer n, and one ÷ symbol, wherein n is an integer from 1 to 12.

* * * * *